US005518185A

United States Patent [19]

Takeda et al.

[11] Patent Number: 5,518,185

[45] Date of Patent: May 21, 1996

[54] ELECTROMAGNETIC VALVE FOR FLUID INJECTION

[75] Inventors: Hideto Takeda, Kariya; Kenzo Kawasaki, Anjo; Sojiro Tsuchiya, Nagoya; Shinzi Sugiura, Anjo; Nobuo Ota, Takahama, all of Japan

[73] Assignee: Nipponfrndo Co., Ltd., Kariya, Japan

[21] Appl. No.: 206,647

[22] Filed: Mar. 7, 1994

[30] Foreign Application Priority Data

Mar. 12, 1993 [JP] Japan ..... 5-051769

[51] Int. Cl.[6] ..... F02M 51/06

[52] U.S. Cl. ..... 239/585.4; 239/585.1

[58] Field of Search ..... 239/585.1, 585.4, 239/585.5

[56] References Cited

U.S. PATENT DOCUMENTS

| | | | |
|---|---|---|---|
| 4,007,880 | 2/1977 | Hans et al. . | |
| 4,235,375 | 11/1980 | Melotti | 239/585.4 X |
| 4,331,318 | 5/1982 | Kamai et al. | 239/585.4 X |
| 4,625,919 | 12/1986 | Soma et al. | 239/585.4 |
| 4,771,984 | 9/1988 | Szablewski et al. | 239/585.4 X |
| 4,967,966 | 11/1990 | Babitzka et al. . | |
| 5,012,982 | 5/1991 | Souma et al. . | |
| 5,016,821 | 5/1991 | Hans et al. | 239/585.4 |
| 5,080,287 | 1/1992 | Takeda et al. | 239/585.1 |
| 5,158,236 | 10/1992 | Sugiyama et al. . | |
| 5,168,857 | 12/1992 | Hickey | 239/585.4 X |
| 5,188,297 | 2/1993 | Asano | 239/585.1 X |
| 5,232,163 | 8/1993 | Grytz | 239/585.1 X |
| 5,232,167 | 8/1993 | McCormick et al. | 239/585.1 X |
| 5,236,174 | 8/1993 | Vogt et al. . | |
| 5,263,647 | 11/1993 | Cerny et al. | 239/585.1 |
| 5,271,563 | 12/1993 | Cerny et al. | 239/585.1 X |
| 5,284,302 | 2/1994 | Kato et al. | 239/585.1 |

FOREIGN PATENT DOCUMENTS 1267353 10/1980 Japan .

*Primary Examiner*—Andres Kashnikow
*Assistant Examiner*—Lesley D. Morris
*Attorney, Agent, or Firm*—Cushman, Darby & Cushman

[57] ABSTRACT

An electromagnetically operated valve for injecting fluid comprises first guiding element connected to one end portion of a stationary iron core and containing a movable core slidably therein for guiding a movement of a movable valve connected to the movable core, and second guiding element for slidably guiding the movable valve in a position between a large-diameter portion and a seat portion of the movable valve. According to such fluid injection valve, as the movable core and movable valve are axially guided by first guiding means and second guiding element in the above respective positions, the wear of the stopper portion of the movable valve is lessened due to the outer force to the movable valve.

13 Claims, 7 Drawing Sheets

ELECTROMAGNETIC VALVE FOR FLUID INJECTION

BACKGROUND OF THE INVENTION

1. Field of the Invention

The present invention relates to a fluid injection valve, for example, it is applicable to fuel injection valve for injecting fuel into internal combustion engines for automobiles.

2. Description of the Related Art

As a conventional type of the fuel injection valve used in internal combustion engines, the electromagnetic fuel injection valve is known as disclosed in the unexamined Japanese Patent Publication No. 3-31570.

This fuel injection valve, as shown in FIG. 8, the needle 1 is movably contained within the body 4. When the electromagnetic coil 33 is electrified, the needle 1 seated on the valve seat at the bottom of the body 4 is attracted upwardly. At this time, a gap is formed between the needle 1 and the valve seat, through which fuel passes, and fuel is injected from the fuel injection port 36 formed at the bottom of the body 4. Fuel injection continues while the electromagnetic coil 33 is electrified, and after the termination of electricity supply, the needle 1 is seated again on the valve seat and the fuel injection stops. The above needle 1 is slidably disposed in the inner surface of the body 4 and axially guided in two guide portions 2, 3. The needle 1 also has a flange 5 in an upward position of the guide portion 2. The flange 5 is formed in a hollow disk shape so as to face a spacer 6 to form a gap therebetween. This flange 5 collides with the spacer 6 when the needle 1 is attracted by electromagnetic force, thereby the upward movement of the needle 1 being limited. The flange 5 and spacer 6 comprise a stopper of the needle 1. The amount of the movement of the needle 1 by electromagnetic force (the amount of full lift) is determined by the distance of the predetermined gap between the flange 5 and the spacer 6.

During this operation, the needle 1 is tilted relative to its axis by the influence of an outer force such as the spring which applies pressure toward the valve seat, and is maintained in contact with the guide portions and the inner surface of the body. When the needle 1 is attracted upwardly while remaining in such tilted condition, the flange 5 collides with the spacer 6 on one side at first, as shown in FIG. 9A. The triangles shown in FIGS. 9A and 9B indicate the contact points between the guide portions and the inner surface of the valve body. After some interval, the top surface of the flange 5 comes entirely in contact with the bottom surface of the spacer 6, as the needle 1 is further attracted by electromagnetic force. At this time, the needle 1 attempts to rotate counterclockwise with the one-sided contact point as the fulcrum. However, as the guide 2 is in contact with the inner surface of the body 4, the needle 1 is not able to rotate, and the flange 5 is finally shifted to the right as shown in FIG. 9 in the position of one-sided contact, the surface of the flange 5 entirely comes in contact with the spacer 6.

Thus, as the flange 5 gouges the bottom surface of the spacer 6 in such a manner, the stopper suffers wear. This stopper wear may cause the instability in the injection quantity or a degradation in durability.

For solving such problems, it should be necessary to maintain the gap between the guides 2, 3 and the inner surface of the body 4 at an extremely accurate clearance. As a result, a high-precision machining becomes necessary, which causes another problem.

SUMMARY OF THE INVENTION

In view of the above problems, the object of the present invention is to provide a fluid injection valve which can reduce the wear on the stopper portion with simple structure.

The another object of the present invention is to provide a fuel injection valve for improving the instability in the injection quantity or a degradation in durability.

Still another object of the present invention is to provide a suitable needle of a fuel injection valve for reducing the wear on the stopper portion.

According to a first aspect of the present invention, an electromagnetically operated valve for injecting fluid comprises first guiding means connected to one end portion of a stationary iron core and containing a movable core slidably therein for guiding a movement of the movable valve connected to the movable core, and second guiding means for slidably guiding the movable valve in a position between a large-diameter portion and a seat portion of the movable valve.

According to a second aspect of the present invention, an electromagnetically operated fuel injection valve for injecting fuel into an internal combustion engine comprises first guiding means connected to one end portion of a stationary iron core and containing a movable core slidably therein for guiding a movement of a movable valve connected to the movable core, and a valve body connected to a top end portion of the first guiding means and having a valve seat which co-operates with a seat portion of the movable valve for injecting fuel therethrough, and second guiding means which guides the movable valve slidably in a position between a large-diameter portion and a seat portion of the movable valve.

According to a third aspect of the present invention, a needle for fuel injection comprises a connecting portion connected to a movable core, a guide portion formed at near position of a seat portion and having a plurality of passages formed on an outer surface thereof, a first flange portion for limiting the movement of the needle formed in a complete round shape near around the guide portion, and a second flange portion formed in a complete round shape between the connecting portion and the first flange portion.

DETAILED DESCRIPTION OF THE PREFERRED EMBODIMENTS

First embodiment of the fluid injection valve of the present invention is explained as below.

The fluid injection valve in this embodiment is applied to a fuel injection valve for a fuel supply device for a gasoline engines.

Figure 1:
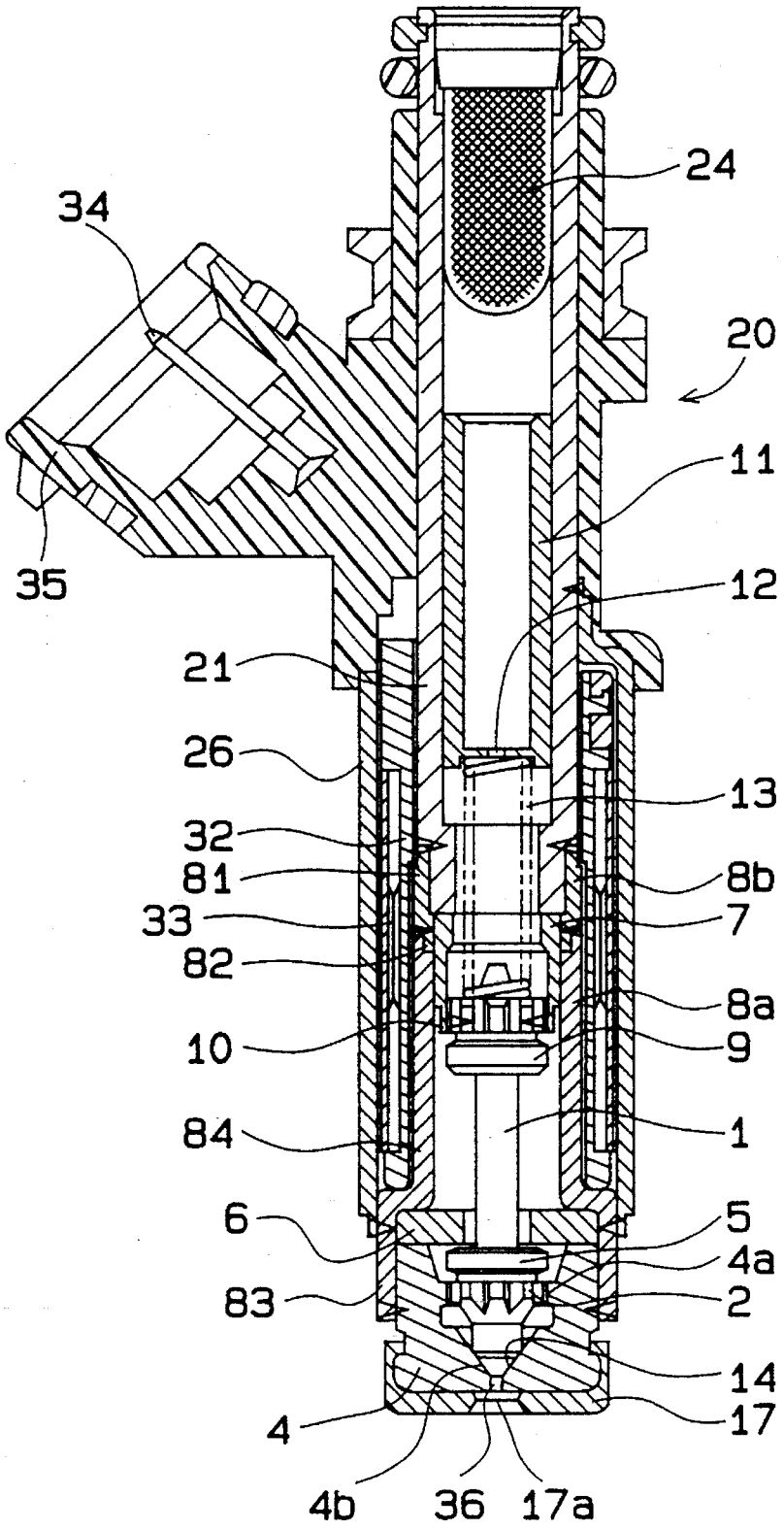
FIG. 1 is a cross-sectional view of the embodiment of the present invention.

As shown in FIG. 1, a fuel injection valve 20 has a yoke 26 of a generally cylindrical shape manufactured from a plate of magnetic material, in which a stationary iron core 21, a movable core 7, a needle 1, a valve body 4, a magnetic pipe 8*a*, a non-magnetic pipe 8*b* and so on are disposed in the axial direction.

A spool 32 made of resin is fixed to the inner circumferential surface of the yoke 26. A magnetic coil 33 is wound around the spool 32.

Furthermore, the spool 32 made of magnetic material and formed in a cylindrical shape is fixed to the outer surface of the stationary iron core 21. The non-magnetic pipe 8*b* is connected to the bottom portion of the stationary iron core 21.

This non-magnetic pipe 8*b* is formed in a stepped pipe with a large-diameter portion 81 and a small-diameter portion 82. The large-diameter portion 81 is connected to the bottom portion of the stationary iron core 21 so as to partially extrude from the bottom end of the stationary iron core 21. The small-diameter portion 84 of the magnetic pipe 8*a* formed in a stepped pipe made of magnetic material is connected to the small-diameter portion 82 of the non-magnetic pipe 8*b*. The inner diameter of the small-diameter portion 82 of the non-magnetic pipe 8*b* is set to be slightly smaller than the inner diameter of the small-diameter portion 84 of the magnetic pipe 8*a*. The valve body 4 is inserted into the large-diameter portion 83 of the magnetic pipe 8*a* via a spacer with a hollow disk shape. On the inner surface of the valve body 4, a cylindrical surface 4*a* in which a guide portion 2 of the needle 1 as described later is slidably disposed is formed, and a valve seat 4*b* on which is seated the conical seat portion 14 of the needle 1. The fuel injection port 36 is formed at the center of the bottom portion of the valve body 4.

A movable core 7 made of magnetic material and formed in a cylindrical shape is disposed in the inner space of the non-magnetic pipe 8*b* and the magnetic pipe 8*a*. The outer diameter of the movable core 7 is set to be slightly smaller than the inner diameter of the small-diameter portion 82 of the non-magnetic pipe 8*b*, and the movable core 7 is slidably disposed in the non-magnetic pipe 8*b*, thereby the movable core being guided. The top surface of the movable core 7 faces the bottom surface of the stationary iron core 21 so as to form a predetermined gap therebetween. The needle 1 is connected to the inner circumferential surface of the bottom end of the movable core 7.

A flange-shaped connecting portion 10 is formed on the top portion of the needle 1. The needle 1 and movable core 7 are connected as a single integrated unit by laser welding the connecting portion 10 and the inner surface of the movable core 7. A flange 9 is formed on the needle 1 below the position of the flange-shaped connecting portion 10.

A flange 5 is also formed on the needle 1, which faces the bottom surface of the spacer 6 disposed in the large-diameter portion 83 of the magnetic pipe 8*a* so as to form a predetermined gap therebetween. This flange 5 is formed near the seat portion 14 formed on the tip of the needle 1, and the guide portion 2 which slides in the inner cylindrical surface 4*a* of the valve body 4 is formed below the position of the flange 5, thereby the needle being guided.

A plurality of knurled grooves are formed on the outer circumferential surface of the connecting portion 10 and the guide portion 2 of the needle 1 by the rolling process or a similar process.

A spring 13, which applies pressure to the movale core 7 in the downward direction in FIG. 1 to seat the seat portion 14 of the needle 1 on the valve seat 4*b* of the valve body 4, is disposed on the top surface of the needle 1 fixed to the movable core 7 by welding. The spring 13 extends from the inside of the movable core 7 to the inside of the stationary iron core 21, and is supported by the adjusting pipe 11 which is inserted into and fixed to the inside of the stationary iron core 21.

The applying pressure of the spring 13 to the needle 1 is adjusted by the axial position of the adjusting pipe 11. Furthermore, an orifice 12 which defines the static injection quantity of the injection valve 20 is formed in the bottom portion of the adjusting pipe 11.

A filter 24 is disposed in an above position of the stationary iron core to remove extraneous material from the fuel which flows into the fuel injection valve 20 supplied from a fuel tank under pressure by a fuel pump (not shown).

The fuel which flows into the stationary iron core 21 passes through the orifice 12 of the adjusting pipe 11, the gap between the movable core 7 and the knurled grooves formed on the connecting portion 10 of the needle 1, and the gap between the cylindrical surface of the valve body 4 and the knurled grooves formed on the guide portion 2 of the needle 1, and leads to the fuel injection port 36.

A connector 35 made of synthetic resin is disposed so as to cover the outer circumferential surface of the portion extending from the top portion of the spool 32 of the stationary iron core 21. A terminal 34 electrically connected to the electromagnetic coil 33 is embedded in the connector 35 and the spool 32. The terminal 34 is connected to an electronic control unit (not shown) via a wire harness (not shown), and exciting current flows from the electronic control unit to the electromagnetic coil 33 via the terminal 34. At this time, the needle 1 and movable core 7 resist the applying pressure of the spring 13 and are attracted toward the stationary iron core 11.

Furthermore, a sleeve 17 made of synthetic resin in the form of a cylinder with a solid bottom end is disposed around the bottom portion of the outer circumferential surface of the valve body 4. A hole is formed in the center of the bottom end of the sleeve 17, and a separator 17*a* is disposed in the hole to divide the fuel injection into two directions toward the respective intake valves of the internal combustion engine.

In this embodiment of the fuel injection valve 20 as described above, the non-magnetic pipe 8*b*, magnetic pipe 8*a*, spacer 6 and valve body 4 comprise a housing of the present invention.

Laser welding is performed on the connecting portion between the fixed iron core 21 and non-magnetic pipe 8*b* along the junction line of the two parts. Such laser welding is carried out over the entire circumferential surface for a fuel seal.

Laser welding is also performed on the connecting portion between the non-magnetic pipe 8*b* and magnetic pipe 8*a* at the along the juncture of the two parts. Such laser welding is carried out over the entire circumferential surface for a fuel seal.

Thus, the laser welding along the junction lines of two materials in this way makes the process dependable and high-reliability regardless of the thicknesses of the two materials.

The top end of the yoke 26 is connected to the stationary iron core 21 by laser welding, and its bottom is also connected to the magnetic pipe 8*a* by laser welding. The bottom end of the magnetic pipe 8*a* is connected to the outer circumferential surface of the valve body 4 at the side of the non-magnetic pipe 8*b* from the valve seat 4*b*. Such laser welding is carried out over the entire circumferential surface for a fuel seal. The movable core 7 is connected to the connecting portion 10 of the needle 1 by laser welding.

In this embodiment as described above, the laser welding of the non-magnetic pipe 8*b* and the magnetic pipe 8*a* is carried out on the outer circumferential surface of the connecting portion 10 for the non-magnetic pipe 8*b* and the movable core 7, however, the position of the laser welding may be shifted in order to prevent deformation due to heat by welding.

Furthermore, laser welding may also be carried out simply by abutting the two end surfaces together, without inner and outer overlap of the non-magnetic pipe 8*b* and magnetic pipe 8*a*.

Laser welding for the yoke 26 may also be carried out along the contact line of the two materials.

Additionally, the position of laser welding as described above are indicated by triangular symbols in FIG. 1.

In the embodiment as described above, the magnetic pipe 8*a* employs a pipe-shaped material with a substantially uniform thickness, however, a material with multiple step-like shape on the outer circumferential surface and having a non-uniform thickness are also applicable. It should be noted that the magnetic pipe 8*a* and non-magnetic pipe 8*b* contain the movable core 7 and needle 1 therein and have a space for a fuel passage.

Although the embodiment shown in FIG. 1 is directed to a top-feed type fuel injection valve, in which the fuel passes through the inner passage in the stationary iron core 21, it is also possible to modify a bottom-feed type fuel injection valve, which has a fuel inlet in the wall of the magnetic pipe 8*a* in the place of the fuel passage in the stationary iron core 21.

The operation of the electromagnetic fuel injection valve having the above structure is explained as below.

Fuel pressurized at a constant pressure by the fuel pump and pressure regulator (not shown) flows into the inner passage formed from the top of the stationary iron core 21 and passes through the filter 24, adjusting pipe 11, and orifice 12, and the gap between the movable core 7 and the knurled groove on the connecting portion 10, further passes through the space formed between the magnetic pipe 8*a* and needle 1 and through the gap between the cylindrical surface of the valve body 4 and the knurled groove formed on the guide portion 2 of the needle 1, and are supplied at upstream of the valve seat 4*b*.

When electric current is supplied from the electronic control unit (not shown) to the electromagnetic coil 33 via the terminal 34 of the connector 35, the electromagnetic coil 33 generates electromagnetic force. By the electromagnetic force, the movable core 7 and the needle 1 connected to the movable core 7 resist the applying pressure of the spring 13 and are attracted upwardly until the flange 5 collides the spacer 6. The needle 1 and movable core 7 are maintained at such contact point by the electromagnetic force of the electromagnetic coil 33.

After an output signal for controlling fuel injection to the electromagnetic coil 33 pauses and the electromagnetic force stops generating, the needle 1 is returned downwardly by the applying pressure of the spring 13 and comes into contact with the valve seat 4*b* of the valve body 4.

While the needle 1 is attracted upwardly and returned downwardly again, fuel passes through the fuel injection port 36 via the gap between the seat portion 14 of the needle 1 and the valve seat 4*b*, is divided into two directions by the separator 17*a* formed in the hole of the sleeve 17, and is injected toward the intake valves (not shown) of the internal combustion engine so as to restrain the fuel from adhering on the walls of the intake manifold (not shown). As the internal combustion engine of this embodiment is equipped with two intake valves, the injected fuel is arranged to be separated into two respective directions. However, in case that this embodiment of the present invention is applied to an engine with three intake valves, the shape of the sleeve 17 is modified for the fuel injection in three directions.

Thus, the needle 1 is guided between two positions of the movable core 7 and the guide portion 2. The flange portion 5 acts as a stopper to limit movement of the needle 1 and is formed between two guide portions 2.

Figure 2A:
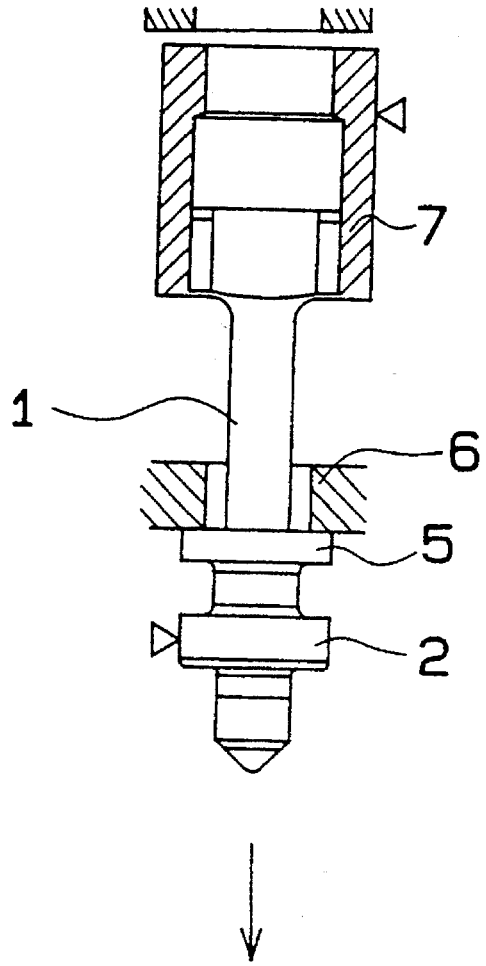
FIGS. 2A and 2B are operational views of the needle 1 shown in FIG. 1 for explaining lift action FIG. 2A showing the point in time at which flange 5 has just collided with spaced 6 and FIG. 2B showing a predetermined time thereafter.
Figure 2B:
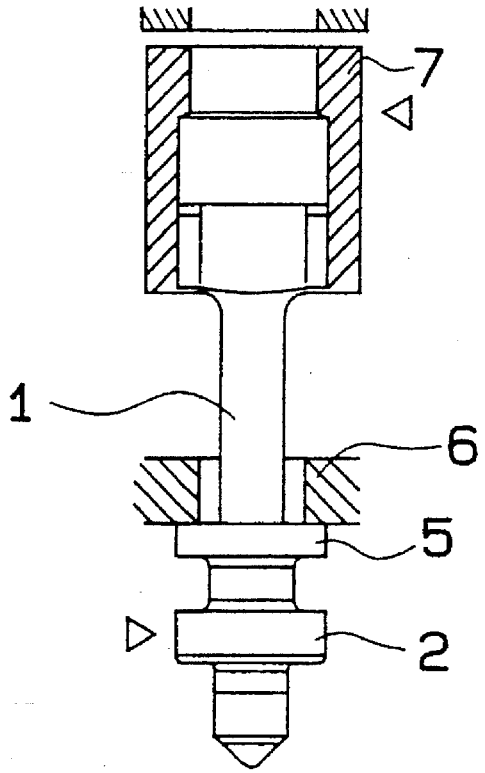
Figure 9A:
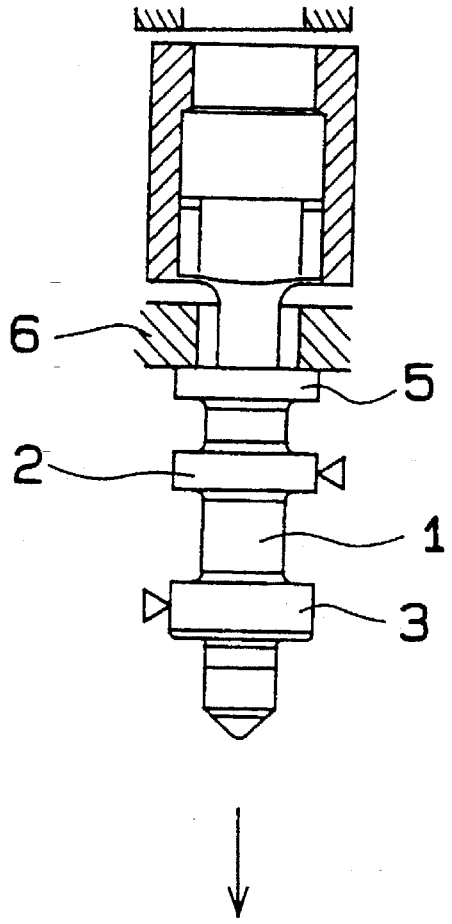
FIG. 9A PRIOR ART
FIGS. 9A and 9B are operational views of the needle 1 shown in FIG. 8 for explaining lift action FIG. 9A showing the point in time at which flange 5 has just collided with space 6 and FIG. 9B showing a pre-determined time thereafter.
Figure 9B:
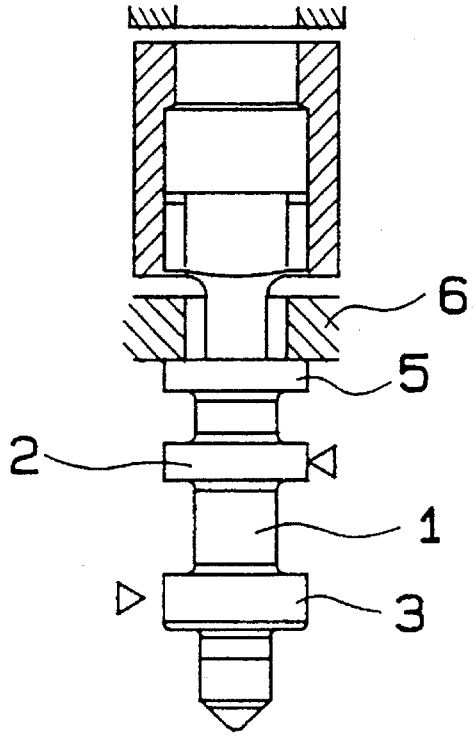
FIG. 9B PRIOR ART

As shown in FIGS. 2A and 2B, when the needle 1 is attracted in a tilted condition relative to the axis, the flange 5 collides with the spacer 6 on one side at first. The triangles in FIGS. 2A and 2B indicate the respective contact points of the two guide positions, namely, of the movable core 7 and the non-magnetic pipe 8*b*, and of the guide portion 2 and the valve body 4. After the collision, the needle 1 is attracted further by the electromagnetic force, and the entire top surface of the flange 5 comes into contact with the bottom surface of the spacer 6. At this time, as the one-sided collision is positioned between the two guide positions as above, the needle 1 rotates clockwise with the collision point as the pivot. For this reason, the movement of the needle 1 which causes gouging of the flange 5 and spacer 6 as shown in FIG. 9 is lessened, and the wear of these two parts due to such gouging is also reduced. Accordingly, problems Such as instability of the injection quantity and deterioration of the durability of the injection valve due to the wear are prevented.

Additionally, gouging of the flange 2 and spacer 6 is lessened by forming these two parts between the two guide portions as above, without particularly precise machining in the clearance between the movable core 7 and the non-magnetic pipe 8*b* and in the clearance between the guide 2 and the cylindrical surface 4*a* of the valve body 4. Accordingly, the injection valve 20 is manufactured easily.

According to such structure of the embodiment as above, as the stationary iron core 21 and valve body 4 are connected by the non-magnetic pipe 8*b* and magnetic pipe 8*a* therebetween, and these are connected by laser welding so as to form a watertight seal, it is not necessary to dispose materials such as rubber O-rings for seals. Moreover, as the flange 5, as the stopper for the needle 1, and as the spacer 6 are positioned close to the second guide position and the seat portions 14, wear of the flange 5 and spacer 6 is reduced even when the dimensional precision of both guide portions for the movable core 7 and needle 1 is not so accurate.

Furthermore, the movement of the needle 1 and movable core 7 is limited by the flange 5 and the spacer 6, a gap between the movable core 7 and the stationary iron core 21 is maintained accurately. In cases that the stationary iron core 21 and movable core 7 collide with each other directly, it is necessary to enhance wear resistance and to improve magnetic characteristics by plating the colliding surfaces or similar means, however, in this embodiment, stability for the operation is enhanced with a simple structure and low-cost.

Furthermore, in the embodiment as above, the movable core 7 is guided by the inner surface of the small-diameter portion 82 of the non-magnetic pipe 8*b*. This small-diameter portion 82 is inserted into the magnetic pipe 8*a*. Meanwhile, the valve body 4 is also inserted into the magnetic pipe 8*a*. Consequently, the valve body 4 and the small-diameter portion 82 of the non-magnetic pipe 8*b*, which is the material for guiding the needle 1, are both positioned with reference to the inner surface of the magnetic pipe 8*a*, and highly precise coaxiality is obtained.

Figure 3:
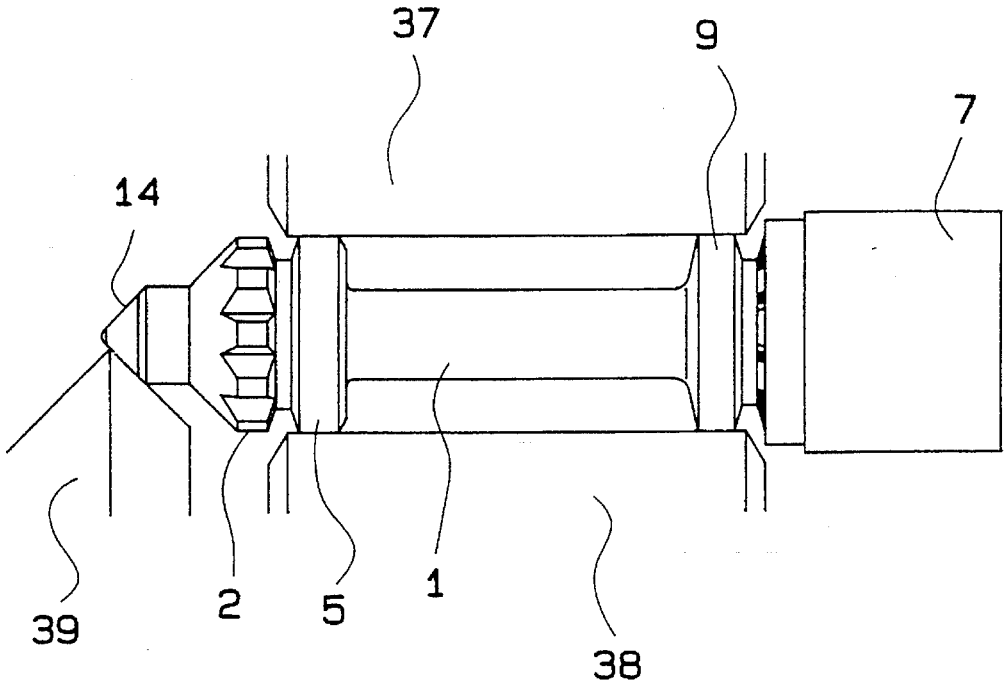
FIG. 3 is an enlarged view of the seat portion of the embodiment shown in FIG. 1.

In addition, on the needle 1 in this embodiment, the knurled grooves are formed as fuel passages on the guide portion 2 and the connecting portion 10 which is connected to the movable core 7. Thess knurled grooves are formed easily by machining methods such as the rolling process as above. Even in case that knurled groove is formed simply in this way, it is also possible to process the seat portion 14 of the needle 1 easily by grinding with flanges 5, 9 as its guide portion, as shown in FIG. 3. This process makes it possible to form the seat 14 while maintaining a reliable roundness. In FIG. 3, workpieces 37, 38 support the flanges 5, 9 and the seat 14 are formed by a grindstone 39.

Figure 4:
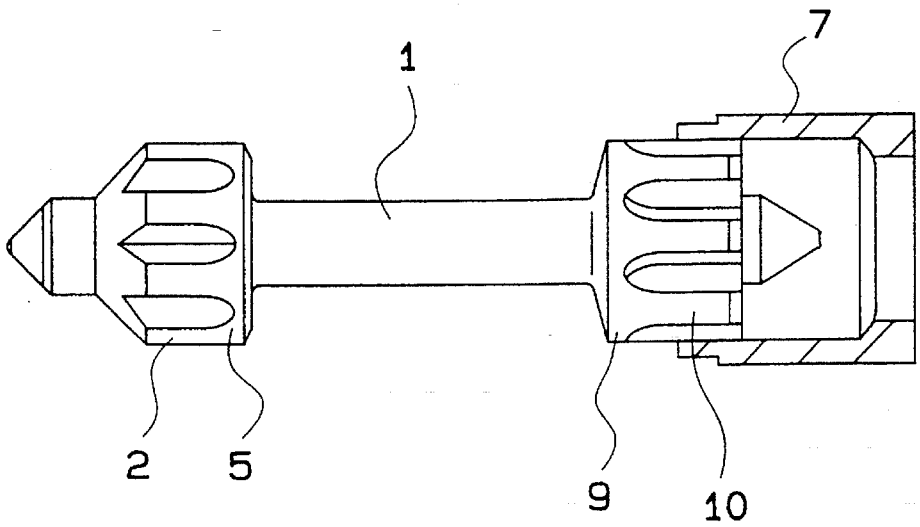
FIG. 4 is an enlarged view of a modification of the needle 1.

It is also applicable that the above-mentioned flanges 5, 9 are continuously formed with the guide portion 2 and connecting portion 10, respectively, as shown in FIG. 4.

Specified values of the fuel injection valve 20 such as the amount of lift of the needle 1 and the diameter of the fuel injection port 36 vary from one to another by the precision in machining. These variations cause variations in the static fuel injection quantity from one to another. In case that the precision of specified values such as the amount of lift and injection port diameter is improved in order to suppress these variations and obtain a uniform static injection quantity, it becomes not suitable for mass-production and lowers productivity. However, in the embodiment as above, it is possible to suppress variations in the static injection quantity for each injection port by selecting a different diameter of the orifice 12 formed on the bottom end of the adjusting pipe 11. A specified static injection quantity is therefore obtained by adjusting the diameter of the orifice 12 after the assembling process. For this reason, it is not necessary to further improve machining precision, and machining is easily processed.

The fuel injection valve in the above embodiment is directed to a single-port adjustable-amount type for injecting fuel from the single injecting port 36. However, the adjustment of the static injection quantity as described in the above embodiment is also applied to a four-nozzle type fuel injection valve as shown in FIGS. 5 and 6.

Figure 6:
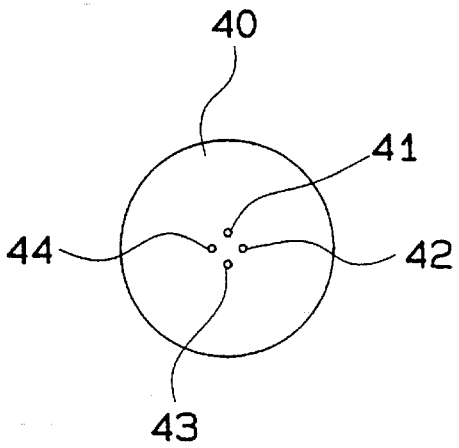
FIG. 6 is a top view of an orifice plate shown in FIG. 5.

This fuel injection valve has an orifice plate 40 formed with four orifices 41, 42, 43, and 44 shown in FIG. 6, which is connected to the bottom of the valve body 4 by welding. The other structure is the same as the single-port adjustable-amount type shown in FIG. 1.

Figure 5:
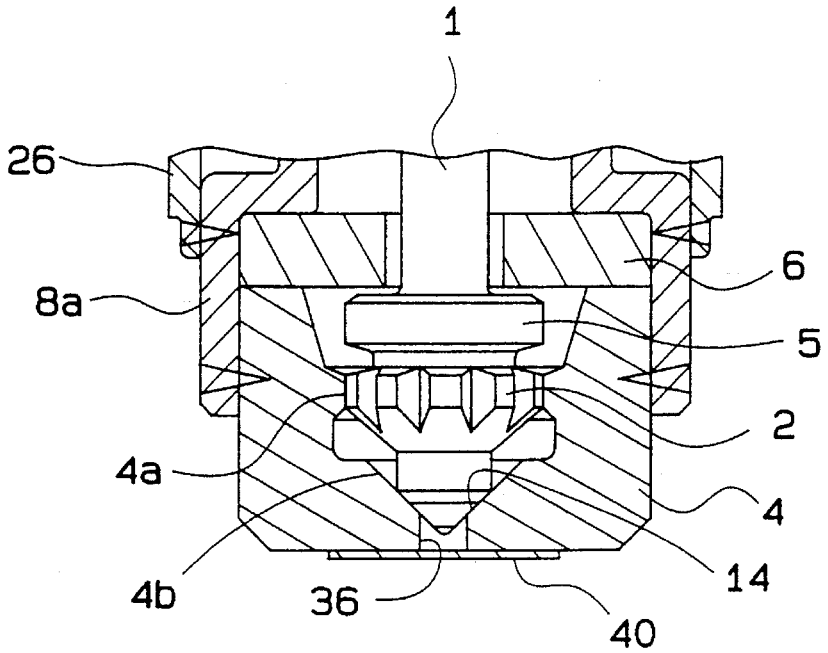
FIG. 5 is an enlarged cross-sectional view of another embodiment.

In the embodiment of the four-nozzle adjustable amount type shown in FIGS. 5 and 6, it is also possible to suppress variations in the static injection quantity for each injection port by selecting the diameter of the orifice formed on the adjusting pipe (not shown) after setting the diameters for each orifice 41, 42, 43 and 44 and setting the amount of lift of the needle 1. As a result, the desired static injection quantity is obtained easily.

A further embodiment of the adjusting pipe 11 is explained as below.

Figure 7:
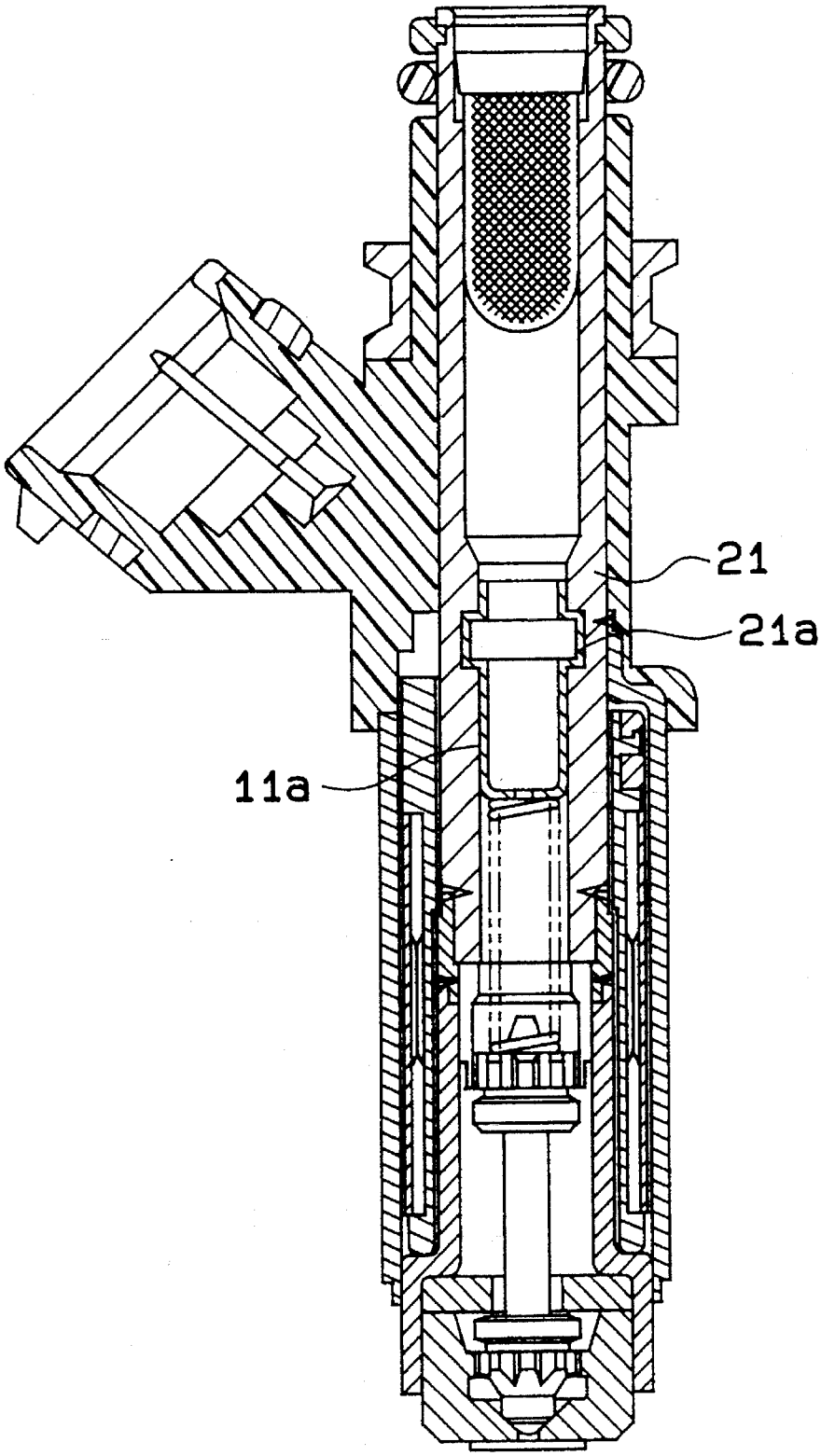
FIG. 7 is a cross-sectional view of another embodiment of the present invention.
Figure 8:
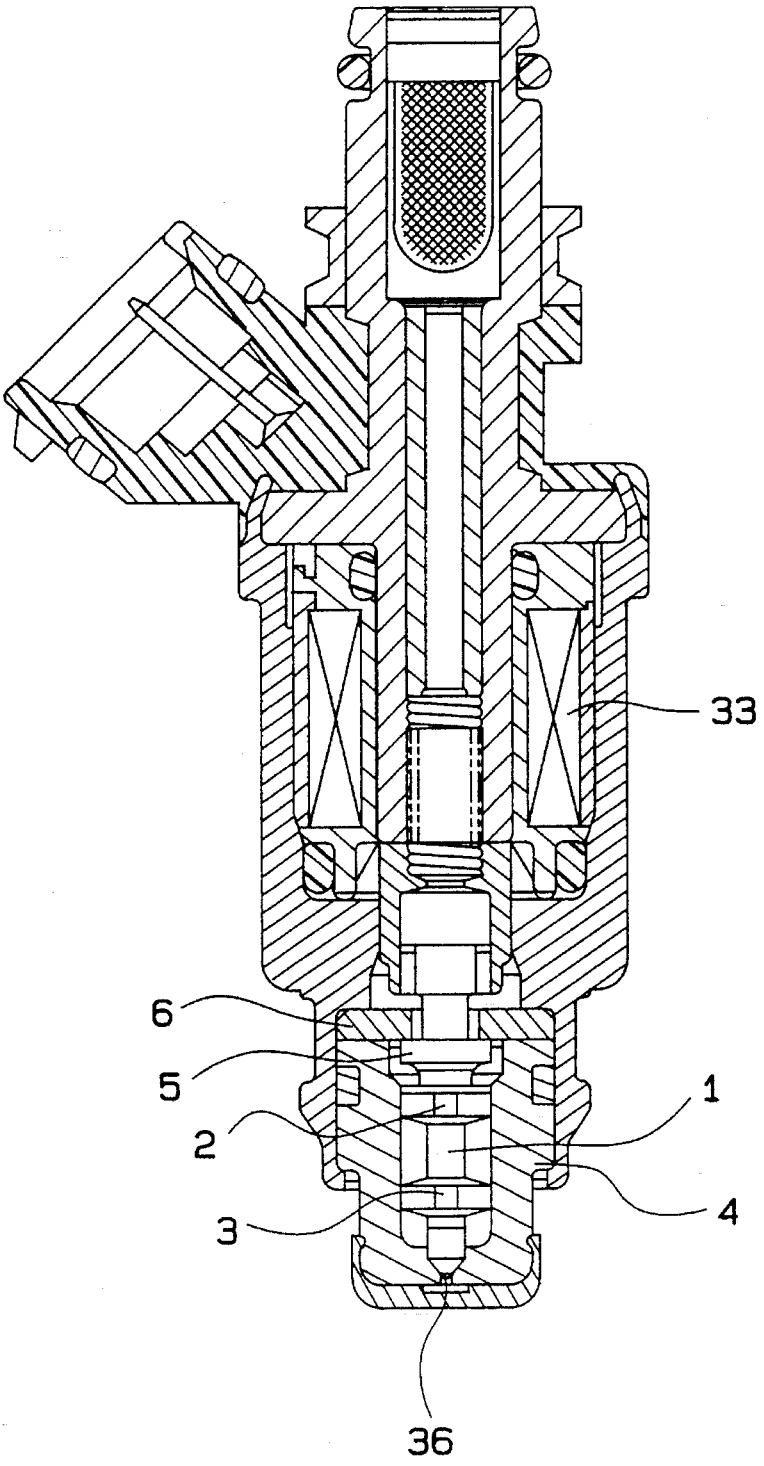
FIG. 8 PRIOR ART
FIG. 8 is a cross-sectional view of a conventional type of fuel injection valve.

The adjusting pipe 11 shown in FIG. 1 is fixed by caulking the outer circumferential surface of the stationary iron core 21. However, as shown in FIG. 7, it is also applicable to form an indentation portion a on an inner surface of the stationary iron core 21, and secure the adjusting pipe by pulling its outer surface in a outer radial direction into the indentation portion a with a specialized jig after inserting such adjusting pipe 11 formed in a thin wall pipe shape into the stationary iron core 21. In addition, the fuel injection valve shown in the FIG. 7 is the same type as the four-nozzle adjustable-amount type shown in FIG. 5, however, such adjusting pipe in FIG. 7 is also applied to the single-nozzle adjustable-amount type shown in FIG. 1.

What is claimed is:

1. An electromagnetically operated valve for injecting fluid comprising:

a stationary iron core;

a movable core facing one end portion of said stationary iron core and being actuated by an electromagnetic force;

a movable valve having a connecting portion connected to said movable core so as to move together, a seat portion at a first end thereof, and a large-diameter flange portion formed between said connecting portion and said seat portion;

first guiding portion means connected to said one end portion of said stationary iron core and containing said movable core slidably disposed therein for guiding movement of said movable valve;

a valve body fixedly connected to a first portion of said first guiding means and having a valve seat which cooperates with said seat portion of said movable valve for injecting fluid therethrough;

a spacer for limiting said movement of said movable valve by electromagnetic force disposed between said connecting portion and said large-diameter flange portion so as to come into contact with said large-diameter flange portion of said movable valve;

second guiding means for slidably guiding said movable valve in a position between said large-diameter flange portion and said seat portion;

wherein said large-diameter flange portion acts as a stopper to limit movement of said needle;

wherein said first guiding means is formed in a pipe shape;

p1 wherein said first guiding means comprises;

a non-magnetic pipe connected to said one end portion of said stationary iron core and extending along an outer surface of said movable core, which contains said movable core slidably therein for guiding said movement of said movable valve; and a magnetic pipe connected to said non-magnetic pipe and extending along said movable valve, which contains said valve body and said spacer.

2. An electromagnetically operated valve according to claim 1, wherein said non-magnetic pipe has a large-diameer portion into which said stationary iron core is inserted, and a small-diameter portion having an inner surface which comes into contact with said movable core.

3. An electromagnetically operated valve according to claim 2, wherein an outer surface of a portion at a side of said stationary iron core is slidably in contact with said inner surface of said small-diameter portion of said non-magnetic pipe.

4. An electromagnetically operated valve according to claim 1, wherein said non-magnetic pipe has an inserting portion inserted into said magnetic pipe, and a contact surface with said movable core is formed on an inner surface of said inserting portion.

5. An electromagnetically operated valve according to claim 1, wherein said stationary iron core and said non-magnetic pipe are watertightly connected by laser welding along an outer junction line thereof.

6. An electromagnetically operated valve according to claim 5, wherein said non-magnetic pipe and said magnetic pipe are watertightly connected by laser welding along an outer junction line thereof.

7. An electromagnetically operated valve according to claim 2, wherein said movable valve has a contact portion which is in contact with said second guiding portion and an outer surface of a portion at a side of said stationary iron core is slidably in contact with said inner surface of said small-diameter portion of said nonmagnetic pipe.

8. An electromagnetically operated valve for injecting fluid comprising:

a stationary iron core;

a movable core facing one end portion of said stationary iron core and being actuated by an electromagnetic force;

a movable valve having a connecting portion connected to said movable core so as to move together, a seat portion at a first end thereof, and a large-diameter flange portion formed between said connecting portion and said seat portion;

first guiding portion means connected to said one end portion of said stationary iron core and containing said movable core slidably disposed therein for guiding movement of said movable valve;

a valve body fixedly connected to a first portion of said first guiding means and having a valve seat which cooperates with said seat portion of said movable valve for injecting fluid therethrough;

a spacer for limiting said movement of said movable valve by electromagnetic force disposed between said connecting portion and said large-diameter flange portion so as to come into contact with said large-diameter flange portion of said movable valve;

second guiding means for slidably guiding said movable valve in a position between said large-diameter flange portion and said seat portion;

wherein said large-diameter flange portion acts as a stopper to limit movement of said needle;

wherein said second guiding means is formed on said valve body; and wherein said second guiding means is formed in only one portion between said movable valve and said valve body.

9. An electromagnetically operated valve according to claim 8, wherein said movable valve has a contact portion which is in contact with said second guiding means, and said contact portion and said large-diameter flange portion of said movable valve are individually formed in a disk-like shape.

10. An electromagnetically operated valve according to claim 9, wherein a plurality of grooves are on said contact portion.

11. An electromagnetically operated valve according to claim 10, wherein said plurality of grooves are formed by a rolling process.

12. An electromagnetically operated valve according to claim 8, wherein said movable valve has a contact portion which is in contact with said second guiding means, and said contact portion and said large-diameter portion of said movable valve are continuously formed in a cylindrical shape.

13. An electromagnetically operated valve according to claim 12, wherein a plurality of grooves are continuously formed only around said contact portion.

* * * * *

UNITED STATES PATENT AND TRADEMARK OFFICE

CERTIFICATE OF CORRECTION

PATENT NO. : 5,518,185

DATED : May 21, 1996

INVENTOR(S) : TAKEDA et al

It is certified that error appears in the above-identified patent and that said Letters Patent is hereby corrected as shown below:

On the title page:

Please change

"item"[73] Assignee: Nipponfrndo Co., Ltd., Kariya, Japan"

to

--item [73] Assignee: Nippondenso Co., Ltd., Kariya, Japan--

Signed and Sealed this

Thirtieth Day of December, 1997

*Attest:*

*Attesting Officer*

BRUCE LEHMAN

*Commissioner of Patents and Trademarks*